United States Patent [19]

Hoshino

[11] Patent Number: 4,702,382

[45] Date of Patent: Oct. 27, 1987

[54] ERECTABLE DISPLAY STRUCTURE WITH REPOSITIONABLE DISPLAY SHELF SECTIONS

[75] Inventor: Yoshihiro Hoshino, Nagoya, Japan

[73] Assignee: Hoshino Gakki Co., Ltd., Japan

[21] Appl. No.: 947,812

[22] Filed: Dec. 30, 1986

[30] Foreign Application Priority Data

Jun. 24, 1986 [JP] Japan ..... 61-096608[U]

[51] Int. Cl.[4] ..... A47F 5/00

[52] U.S. Cl. ..... 211/134; 211/86

[58] Field of Search ..... 211/134, 186, 86, 90, 211/94.5; 248/454

[56] References Cited

U.S. PATENT DOCUMENTS 2,776,757 1/1957 Schoenlaub ..... 211/86

2,994,366 8/1961 Hoch ..... 211/86 X 3,664,629 5/1972 Reed ..... 248/454 X

*Primary Examiner*—Ramon O. Ramirez

*Assistant Examiner*—Blair M. Johnson

*Attorney, Agent, or Firm*—Ostrolenk, Faber, Gerb & Soffen

[57] ABSTRACT

A display comprises a shelf whose tilt orientation may be adjusted. Attached beneath the shelf is a pair of parallel rails. An annular pipe extends transversely across and beneath the rails. There are clamps on the pipe which include an engagement part that engages an adjacent side of a respective rail. The clamps are movable along the pipe and each is clamped at a location along the pipe in engagement with the rail. The clamp is adjustable to any tilt orientation around the pipe.

9 Claims, 6 Drawing Figures

ERECTABLE DISPLAY STRUCTURE WITH REPOSITIONABLE DISPLAY SHELF SECTIONS

BACKGROUND OF THE INVENTION

The present invention relates to a display which may readily be assembled and dismantled and which includes a display shelf that may be mounted on a pipe such that it may be longitudinally adjusted along the pipe, and translatably adjusted perpendicular to the axis of the pipe and rotated around the pipe. This enables appropriate setting and placement of the shelf to display merchandise. For example, it is possible to arrange the shelf tilted in an easel arrangement at an appropriate angle for displaying objects. In addition, by providing the same means of attachment of the shelf to a pair of parallel pipes, it is possible to provide for support of large or irregular objects on the shelf, while assuring that these objects will be fully supported.

Displays have been assembled by combining pipes which carry shelves or ornamental pieces. It has been customary to drill a bolt hole through both the supporting pipe and the supported shelf to eventually connect them. However, the hole or the connecting bolt may be visible on the surface of the shelf, which detracts from the appearance of the display.

One of the major problems that is encountered in the preparation of such a display is that attaching the shelf to the support pipe so that it is adjustable along the length of the pipe longitudinally or is translatably adjustable at an angle to the axis of the pipe has required the use either of permanent openings in the shelf or of openings which must then be drilled for the particular relationship. When the display is thereafter dismantled prior to later reassembly, or when the shelves are to be rearranged to carry different devices, the openings which had been specially drilled or the preformed preparatory openings become visible when the new adjustment is obtained, which mars the appearance of the shelves and the display. Sometimes the display must be rearranged in an attempt to cover the existing holes.

Even where the pipes and/or shelves have been mass produced at fixed standard sizes, it has been difficult to pre-drill holes in them without any dimensional error in the prescribed location on both the pipes and the shelves. In addition, it has been expensive to pre-drill holes.

SUMMARY OF THE INVENTION

The major object of the present invention is to provide a mounting for an adjustable shelf with respect to a support pipe.

A further object of the invention is to enable the shelf to be moved longitudinally along the pipe, to be translated in a direction across the pipe or to be rotated around the axis of the pipe.

A further object of the invention is to enable the shelf to be secured, loosened and then secured again at a new location.

Yet another object of the invention is to enable securement of the shelf without the need for providing preset openings in the shelf.

Yet another object of the present invention is to provide a pipe supported shelf display which does not require the utilization of cooperating holes to be provided on the shelf and in the pipe or other support structure.

In order to carry out the foregoing objects the present invention provides that the shelf be supported on one or more, and preferably a pair, of parallel, longitudinal rails which in turn are individually supported through clamps which may be moved longitudinally on one or more pipes that extend across and transversely of and beneath the rails. The shelf may be moved translatably along the direction of the rails transversely to the axis of the pipe to obtain the best position for the shelf with respect to the axis of the pipe. The shelf may also be moved along the pipe parallel to the axis of the pipe. The clamping of the pair of horizontal rails to an individual pipe enables the shelf to also be rotated around the axis of the pipe. Thus, the shelf has three degrees of movement to establish its desired angular position with respect to the axis of the pipe, without being constrained by any other structure.

The rails engage the shelf other on the underside of the shelf, which conceals the rails. The engagement can be initially varied by simply sliding the shelf along the length of the rails. The rails in turn are carried on clamps which are clamped to the pipe and which are moved longitudinally along the pipe and reclamped where desired. cl BRIEF DESCRIPTION OF THE DRAWINGS The foregoing and many other objects and features of the present invention will become apparent from the following description of the accompanying drawings in which:

FIG. 1 a partial perspective view taken from underneath shelf showing essential elements of the rails which support the shelf and the clamps which in turn support the rails and the shelf on the pipe.

DESCRIPTION OF THE PREFERRED EMBODIMENTS

Figure 1:
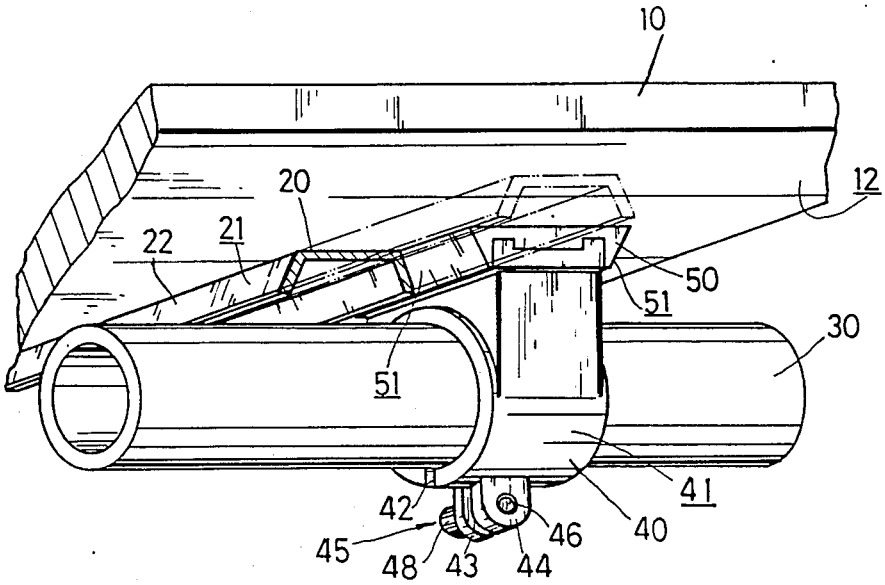

Referring to FIG. 1, an annular metal pipe 30, which is comprised preferably of either stainless steel or aluminum, provides the main support for the below described shelf. As herein described, the shelf may be supported in any desired position along the pipe and may be supported at any tilt angle around the pipe. The shelf may be supported horizontally or be rotated out of the horizontal, for instance, to serve as an easel or as a support for partially suspended objects.

Figure 2:
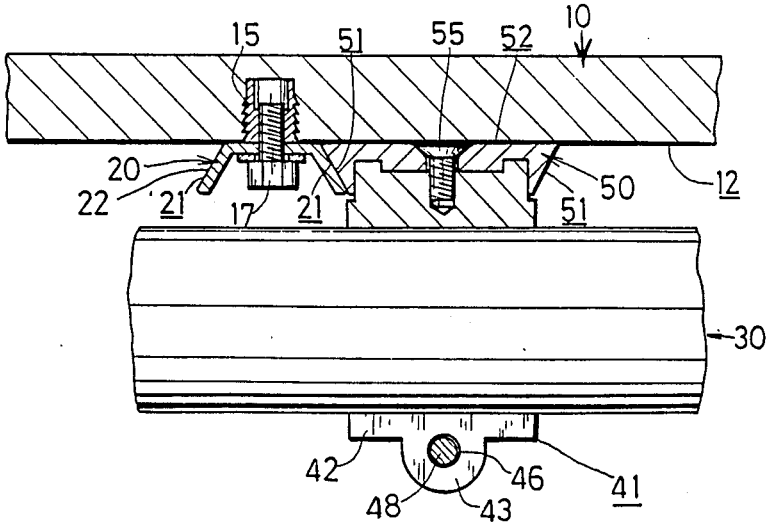
FIG. 2 is a side view, partly in longitudinal cross-section, of the pipe and shelf arrangement.
Figure 3:
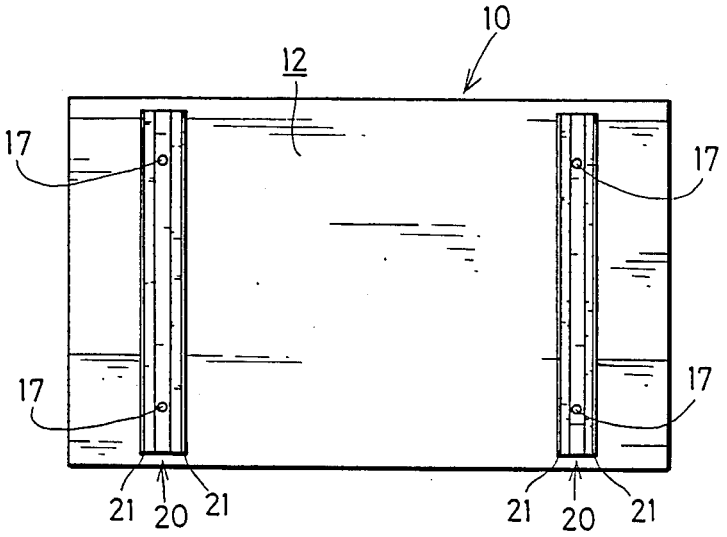
FIG. 3 is a bottom plan view showing the relationship of the rails to the shelf.

The shelf 10 may be a flat plate of any desired material, such as wood. The shelf has on its underside at least one rail 20, but usually a pair of rails, which is or are secured to the underside of the shelf, one rail toward each edge margin of the underside of the shelf 10. The rails are generally parallel and they extend at right angles to the axis of the pipe 30 to which each rail is attached. Each rail 20 is of generally U-shape, with a pair of arms 21 which are spaced apart. Each arm is inclined outwardly from the other arm, as can be seen in FIG. 2. Each outwardly inclined arm 21 meets the underside of the shelf at an acute angle, and each arm 21 defines a respective tapered surface 22 which engages the below described engagement part 50 at cooperatingly oriented surface 51 thereof. The engagement part is received in an engagement space or groove defined between the surface 22 and the underside of the shelf. The two arms 21 and their respective surfaces 22 enables the rails to be disposed at any location along the pipe 30 and for a pair of rails to cooperate in supporting the shelf.

The rail 20 is secured to the underside of the shelf 10 by the removable bolt 17 which is screwed into the threaded socket 15 which is installed in a bore in the underside of the shelf. Neither the bolt 17, nor the socket 15 nor the hole in the shelf are in or project through the top of the shelf.

Figure 5:
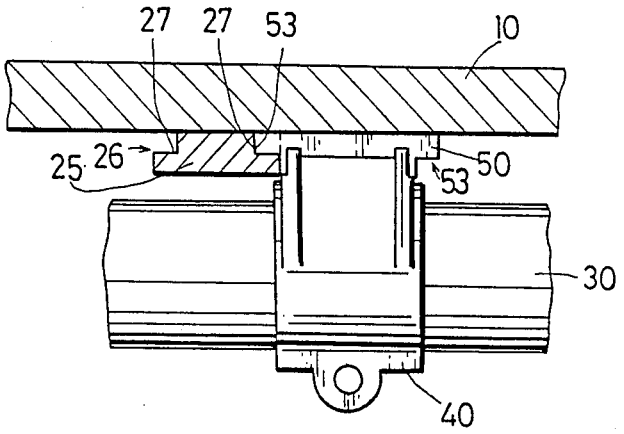
FIG. 5 is a side view partly in longitudinal cross-section showing the connection of the rails and the pipe.

The rail may be differently configured. The rail 25 shown in FIG. 5 is generally inverted T-shaped with the leg of the T secured beneath the shelf. The rail 25 defines a respective groove 26 on each lateral side of the rail 25. Each groove is defined by a step 27 which cooperates with the correspondingly shaped projecting step 53 on the engagement part in FIG. 5.

A respective sliding clamp 40 with its own engagement part for each rail 20 is provided on the pipe 30. The clamp 40 has a tubular main body 41 which is provided with a fixed part 45 and a rail engagement part 50.

As shown in FIGS. 1 and 2, the fixed part 45 of the tubular main body 41 is a split ring clamp. A tightening bolt 48 is screwed between the flanges 43, 44 which are formed at the split ends of the split ring at the split groove 42. The bolt 48 draws the flanges 43, 44 together, clamping onto the pipe 30 on rotation of the bolt in one direction and separating the flanges for releasing the clamping upon bolt rotation in the opposite direction. With the bolt 48 loosened, the clamp 40 may be slid along the pipe 30 to engage any rail on any shelf disposed anywhere along pipe 30. The main body 41 of the clamp also may be clamped at any tilt orientation for the shelf with respect to the floor, either parallel to the floor or at another angle to the floor. Thus, a shelf supported on rails 20 and clamps 40 on pipe 30 has three degrees of movement, along the axis of the pipe 30, rotatable around the pipe 30 and along the rail, which is transversely to the axis of the pipe.

The top of the clamp 40 includes a dovetail shaped engagement part which is engageable with the shelf 10 by insertion into and sliding along the engagement groove which is formed at the underside 12 of shelf 10 at one arm 21 at one side of a rail 20. The dovetail shape includes a tapered surface 51 which fits against tapered surface 22 of the rail 20. Surface 52 at the top of the engagement part seats against the bottom side of the shelf 12. The engagement part includes the top of the clamp main body 41 and the dovetail shaped engagement part 50 which is held to the main body by bolt 55

In the alternate embodiment shown in FIG. 5, the engagement part 50 on the sliding clamp 40 is a step shaped upright T-shaped part rather than a dovestep tail. The rail 25, instead of having a tapered side, also has a step for cooperating with the cross bar 53 of the part to hold the clamp 40 to the rail 25.

Figure 4:
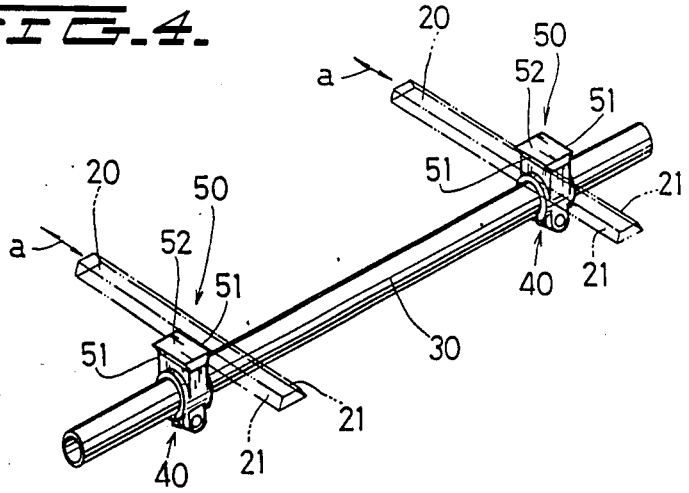
FIG. 4 is a schematic view in perspective and partly in phantom showing the arrangement of the rails for the shelf and the support for the rails on the pipe.

The shelf 10 is installed on the pipe 30 in the following way. The two sliding clamps 40, which are to be disposed toward opposite ends of the shelf, are slid along the pipe 30, as shown in FIG. 4, to the desired location for the rails 20 for the shelf 10 to be supported thereby. Preferably, the two clamps are disposed between the two rails 20 so that the clamps may both be moved outwardly to engage the respective rails. One inclined side 51 of the engagement part 50 is pressed against the tapered surface 22 on one of the rails. Then the clamp 40 is securely clamped at the corresponding location along the pipe 30. In this manner, the plate 10 is supported to the rail, the engagement part and the pipe 30.

Although only a single pipe 30 to which the rails are clamped is illustrated in the drawings, the shelf or the items to be supported on the shelf may be so large or so heavy or off-center on the shelf that there is a danger that the shelf may rotate around a single pipe 30. In that case, a pair of the pipes 30 may be arranged parallel to each other. Each pipe would be provided with respective clamps, all having engagement parts 50 that cooperate with the rails 20 that are of appropriate length for assuring adequate support of the shelf on the pipes.

Figure 6:
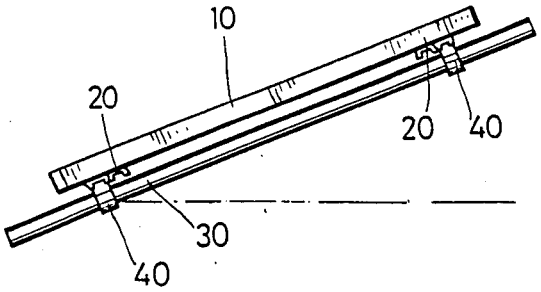
FIG. 6 is a partial, somewhat schematic, view showing a shelf supported in an inclined manner.

FIG. 6 illustrates how the shelf may be disposed at any inclination or orientation. FIG. 6 shows the pipe 30 at an incline, and the shelf is thereby shown tilted. It is possible for the pipes to be horizontal and for the rails to be inclined by tightening the clamp 40 around the pipe with the shelf at a tilted orientation. Any combination of inclined pipe and/or rotated orientation of the shelf and clamp around the pipe is possible to effect any desired inclination of the shelf for a particular application.

Means for installation is provided for shelves at any desired position along a supporting structure and at any tilt angle or inclination thereto or to the surface on which the supporting structure rests without the necessity for predrilling any special holes in the shelf and without any need to locate special mounting holes and without the need for redrilling holes when it is desired to shift the support area.

As it is possible to select the position for the shelf and the pipe by freely sliding them as described above, assembly and dismantling of the structure is facilitated and the display also keeps its good appearance.

In the foregoing, the present invention has been described in connection with preferred embodiments thereof. Since many variations and modifications of the present invention will become obvious to those skilled in the art, it is preferred that the scope of the invention be determined, not by the specific disclosures herein contained, but only by the appended claims.

What is claimed is:

1. A display comprising:

a shelf for being supported at a desired tilt orientation, the shelf having an underside;

a plurality of rails disposed to the underside of the shelf; each rail including a side surface thereon;

a supporting pipe disposed beneath the shelf and the rails and extending transversely past the rails; a respective clamp on the pipe for each of the rails of the plurality; each clamp being movable along the pipe and being clampable to the pipe at any selected location along the pipe; the clamp including an engagement part shaped for engaging the side surface of the rail for engaging the rail to the engagement part; the respective clamps and their engagement parts being so disposed that with each rail engaged by a respective engagement part of a respective clamp, the shelf is supported on the rail and the rail is supported to the engagement part which is supported to the clamp and the clamp is supported to pipe, thereby to support the shelf to the pipe.

2. The display of claim 1, wherein the pipe is so shaped and the clamp is so shaped that the clamp may be rotated around the pipe, for adjusting the tilt orientation of the engagement part around the pipe, and with the engagement of the engagement part with the rail, for adjusting the angular orientation of the shelf around the pipe.

3. The display of claim 2, wherein the pipe is circular in cross section.

4. The display of claim 3, wherein the clamp is generally C-shaped for clamping around the pipe, and the C-shaped clamp includes end flanges at the free ends of the C, and means for clamping together the end flanges for clamping the clamp to the pipe at a selected rotative orientation around the pipe.

5. The display of claim 1, wherein the rail side surface runs along the side of the rail and has a first shape adapted to receive and hold the engaging part, the engaging part of the respective clamp has a corresponding side of a second shape so shaped as to be supported by the adjacent, facing side surface of the rail when the engagement part is brought into engagement with the rail.

6. The display of claim 5, wherein the rail side surface is inclined at an acute angle to the underside of the shelf which defines a supporting groove and the engagement part corresponding side is cooperatingly inclined for being received in the supporting groove.

7. The display of claim 5, wherein the side surface of the rail is grooved to define an undercut step and the engagement part corresponding side has a projecting flange which projects over the undercut step for being supported on the step, thereby supporting the engagement part to the rail.

8. The display of claim 5, wherein the rail has opposite lateral sides and both lateral sides thereof are a respective engaging part side surface.

9. The display of claim 1, wherein the rails are parallel.

* * * * *